US008066210B2

(12) United States Patent
Eriksson et al.

(10) Patent No.: US 8,066,210 B2
(45) Date of Patent: Nov. 29, 2011

(54) CENTRAL SHAFT FOR A GYRATORY CRUSHER

(75) Inventors: Bengt-Arne Eriksson, Svedala (SE); Michael Saarnack, Malmö (SE)

(73) Assignee: Sandvik Intellectual Property AB, Sandviken (SE)

( * ) Notice: Subject to any disclaimer, the term of this patent is extended or adjusted under 35 U.S.C. 154(b) by 129 days.

(21) Appl. No.: 12/654,189

(22) Filed: Dec. 14, 2009

(65) Prior Publication Data

US 2010/0155518 A1 Jun. 24, 2010

(30) Foreign Application Priority Data

Dec. 17, 2008 (SE) ..... 0802585

(51) Int. Cl.
*B02C 4/32* (2006.01)
*B02C 7/14* (2006.01)
*B02C 9/04* (2006.01)
*B02C 11/08* (2006.01)

(52) U.S. Cl. ..... 241/36; 241/211; 241/213; 241/216

(58) Field of Classification Search ..... 241/34, 241/36, 207–216

See application file for complete search history.

(56) References Cited

U.S. PATENT DOCUMENTS 3,666,188 A * 5/1972 Lippmann ..... 241/213
3,743,193 A * 7/1973 DeDiemar et al. ..... 241/207
3,750,809 A * 8/1973 DeDiemar et al. ..... 241/209
3,908,915 A * 9/1975 Milenkovic ..... 241/208
4,206,881 A 6/1980 Werginz
4,666,092 A * 5/1987 Bremer ..... 241/214
5,732,896 A * 3/1998 Jakob et al. ..... 241/215
6,581,860 B2 * 6/2003 Savolainen ..... 241/101.3
6,648,255 B2 * 11/2003 Martinez et al. ..... 241/209
2011/0006143 A1 * 1/2011 Gunnarsson et al. ..... 241/215

FOREIGN PATENT DOCUMENTS

EP 0 976 454 2/2000

OTHER PUBLICATIONS

International Search Report mailed Mar. 17, 2010 issued in PCT Application No. PCT/SE2009/051386.
Search Report dated Jun. 12, 2009.

* cited by examiner

*Primary Examiner* — Bena Miller
(74) *Attorney, Agent, or Firm* — Drinker Biddle & Reath LLP

(57) ABSTRACT

A central shaft for a gyratory crusher, which includes a crushing head on which a first crushing shell is mounted; a frame on which a second crushing shell is mounted, which second crushing shell defines, together with the first crushing shell, a crushing gap; and a driving device, which is arranged to rotate an eccentric about said central shaft and thereby to cause the crushing head to execute a gyratory movement for crushing of material that is introduced in the crushing gap. The central shaft has a cavity in which are accommodated an anti-reverse and a torque limiter, the anti-reverse and the torque limiter being adapted for connection to said crushing head for restricting spinning.

12 Claims, 2 Drawing Sheets

CENTRAL SHAFT FOR A GYRATORY CRUSHER

CROSS-REFERENCE TO PRIOR APPLICATION

This application claims priority to Sweden Application No. 0802585-0 filed Dec. 17, 2008, which is incorporated by reference herein.

FIELD OF THE INVENTION

The present invention relates to a central shaft for a gyratory crusher, which comprises a crushing head on which a first crushing shell is mounted; a frame on which a second crushing shell is mounted, which second crushing shell defines, together with the first crushing shell, a crushing gap; and a driving device, which is arranged to rotate an eccentric about said center shaft and thereby to cause the crushing head to execute a gyratory movement for crushing of material that is introduced in the crushing gap. The invention further relates to a gyratory crusher comprising such a central shaft.

BACKGROUND OF THE INVENTION

A gyratory crusher of the kind stated above can be used for crushing, for example, ore and rock material into smaller size. A problem associated with gyratory crushers of this kind is that during an interruption in the supply of feed material to the crusher the crushing head will start to rotate, after only a short while, at the same high speed as the eccentric, which is generally referred to as spinning. If the crushing head is spinning when feed material is again introduced into the gyratory crusher, there is a risk that material will be ejected from the crusher and/or that the crushing shells will be damaged. Another problem is that the service life of the crusher bearings can be shortened should spinning of the crushing head occur frequently.

U.S. Pat. No. 6,648,255 discloses a gyratory crusher. The head of the crusher is provided with a one-way clutch to inhibit spinning and a friction torque limiting clutch to protect the one-way clutch against excessive loads.

There is sometimes a need for a gyratory crusher of lower height, since a tall crusher takes up more space and its feed opening for the input of material to be crushed is located higher up than in a crusher of low height.

SUMMARY

An object of the present invention is to provide a central shaft for a gyratory crusher capable of restricting spinning, whereby the above drawbacks associated with the prior art are significantly reduced or completely eliminated.

This object is achieved by a central shaft for a gyratory crusher, which comprises a crushing head on which a first crushing shell is mounted; a frame on which a second crushing shell is mounted, which second crushing shell defines, together with the first crushing shell, a crushing gap; and a driving device, which is arranged to rotate an eccentric about said central shaft and thereby to cause the crushing head to execute a gyratory movement for crushing of material that is introduced in the crushing gap, said central shaft having a cavity, in which are accommodated an anti-reverse and a torque limiter, the anti-reverse and the torque limiter being adapted for connection to said crushing head for restricting spinning.

An advantage of a central shaft of this kind is that the anti-spin assembly can be designed in such a manner that it does not add appreciably to the height of the crusher. Moreover, fewer mechanical components are required in the crushing head, which is advantageous as the crushing head is subjected to extreme mechanical stress. As a result, the number of unwanted shutdowns can be reduced.

According to one embodiment, the cavity has an opening in the upper end surface of the central shaft.

According to one embodiment, the central shaft comprises a support piston, which is arranged in the cavity and which is vertically displaceable relative to the central shaft, the support piston preferably supporting and at least partly surrounding the torque limiter and the anti-reverse. This facilitates the connection of the torque limiter and the anti-reverse to the crushing head of a crusher with a vertically adjustable first crushing shell. Preferably, the support piston is arranged to support a thrust bearing on which the crushing head is carried, the torque limiter and the anti-reverse being disposed under said thrust bearing. An advantage of this embodiment is that a crusher of very low height can be obtained.

According to one embodiment, the torque limiter is a slip clutch, preferably of the wet disc type. An advantage of a wet clutch is that it is not affected by splashes of lubricant from other components incorporated in the crusher. Preferably, the slip clutch is located under the thrust bearings between the central shaft and the crushing head, which means that said insensitivity to lubricant is a particularly desirable property if the crusher has force-feed lubricated thrust bearings.

According to one embodiment, the anti-reverse is located above the torque limiter. In this case, the torque limiter is preferably connected to the crushing head by way of the anti-reverse. This relative position allows for a simplified construction of a torque limiter of the wet disc clutch type, since the risk that oil will leak from the wet disc clutch housing to other components incorporated in the central shaft, for example the anti-reverse, is reduced.

According to a further aspect of the invention, the object is achieved by a gyratory crusher, which comprises a crushing head on which a first crushing shell is mounted; a frame on which a second crushing shell is mounted, which second crushing shell defines, together with the first crushing shell, a crushing gap; a central shaft of the above design, an eccentric being rotatably arranged about said central shaft; and a driving device, which is arranged to rotate the eccentric and thereby to cause the crushing head to execute a gyratory movement for crushing of material that is introduced in the crushing gap, the crushing head being connected to the central shaft by way of said anti-reverse and said torque limiter.

According to one embodiment, the crushing head is connected to the central shaft by way of a universal joint shaft, which is provided with at least one universal joint. Preferably, the universal joint shaft is divided into an upper shaft section and a lower shaft section, which shaft sections are rotationally locked together and axially displaceable relative to each other by means of at least one projecting portion, such as splines, which extends along the universal joint shaft.

The present invention enables the provision of spinning restriction in a gyratory crusher without adding unnecessarily to the height of the crusher. Furthermore, the operational reliability of the crusher can be improved by the invention. Further advantages and features of the invention will be apparent from the following description and the appended claims.

In one aspect of the invention, there is provided a central shaft for a gyratory crusher, comprising a crushing head on which a first crushing shell is mounted; a frame on which a second crushing shell is mounted, the second crushing shell and first crushing shell defining a crushing gap; and a driving device arranged to rotate an eccentric about said central shaft and thereby to cause the crushing head to execute a gyratory movement for crushing of material that is introduced in the crushing gap, wherein the central shaft has a cavity in which are accommodated an anti-reverse and a torque limiter, the anti-reverse and the torque limiter for connection to said crushing head for restricting spinning.

In another aspect of the invention, there is provided a gyratory crusher, comprising a crushing head on which a first crushing shell is mounted; a frame on which a second crushing shell is mounted, the second crushing shell and first crushing shell defining a crushing gap; a central shaft having a cavity in which are accommodated an anti-reverse and a torque limiter, the anti-reverse and the torque limiter for connection to said crushing head for restricting spinning; an eccentric being rotatably arranged about said central shaft; and a driving device, which is arranged to rotate the eccentric and thereby to cause the crushing head to execute a gyratory movement for crushing of material that is introduced in the crushing gap, the crushing head being connected to the central shaft by way of said anti-reverse and said torque limiter.

BRIEF DESCRIPTION OF THE DRAWINGS

The invention will be described below by means of embodiments and with reference to the appended drawings.

DETAILED DESCRIPTION OF THE PREFERRED EMBODIMENTS

Figure 1:
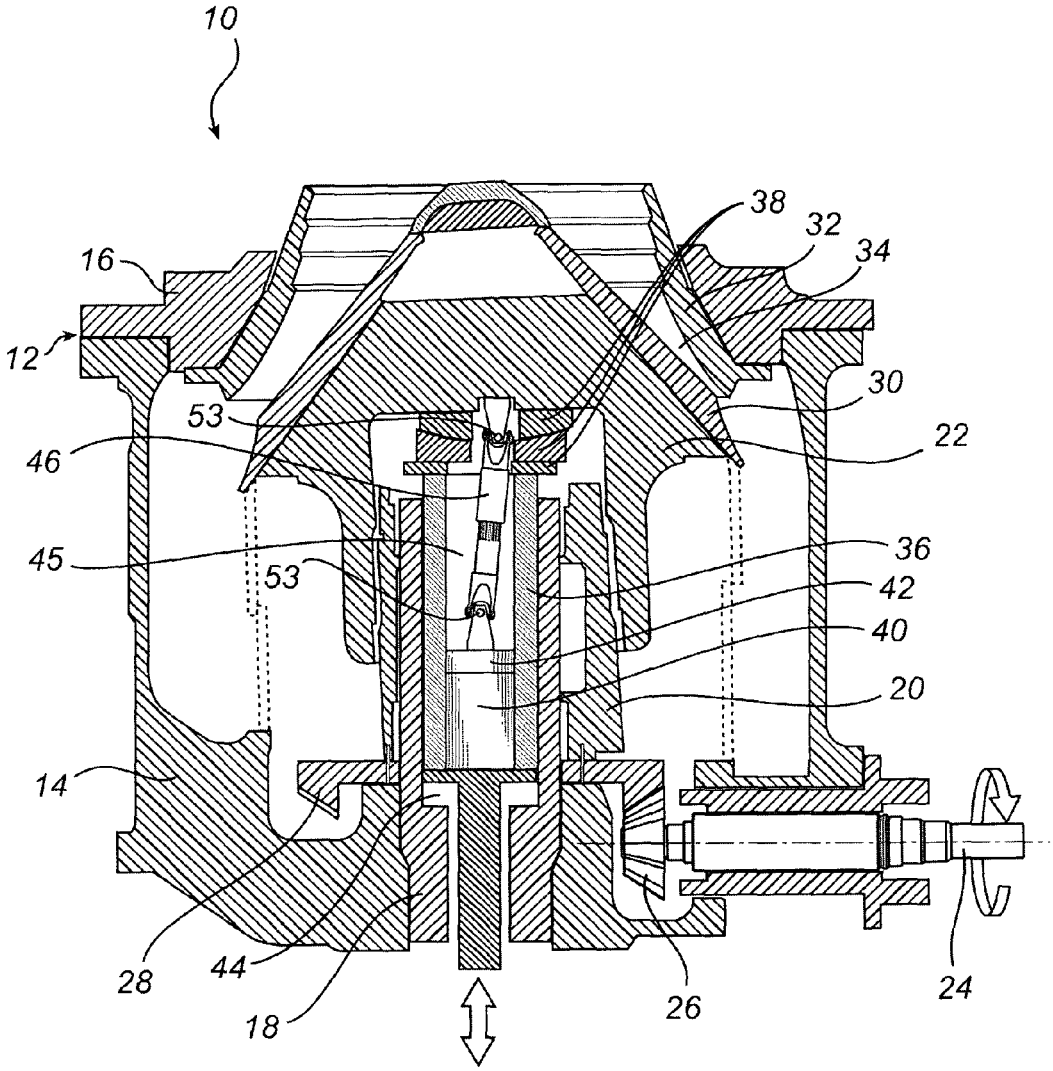
FIG. 1 is a schematic sectional view of a gyratory crusher which is provided with a central shaft capable of restricting spinning.

FIG. 1 illustrates schematically a gyratory crusher 10, which has a frame 12, comprising a frame bottom part 14 and a frame top part 16. A vertical central shaft 18 is fixedly attached to the frame bottom part 14 of the frame 12. An eccentric 20 is rotatably arranged about the central shaft 18. A crushing head 22 is rotatably mounted about the eccentric 20, and thus about the central shaft 18. A drive shaft 24 is arranged to cause the eccentric 20 to rotate about the central shaft 18 by means of a conical gear wheel 26 engaging with a gear rim 28 connected to the eccentric 20. The outer periphery of the eccentric 20 is slightly inclined relative to the vertical plane, which is illustrated in FIG. 1*a* and which is per se known in the art. Because of the inclination of outer periphery of the eccentric 20 the crushing head 22 will also be slightly inclined relative to the vertical plane.

A first crushing shell 30 is fixedly mounted on the crushing head 22. A second crushing shell 32 is fixedly mounted on the frame top part 16. Between the two crushing shells 30, 32 a crushing gap 34 is formed, the width of which, in axial section as illustrated in FIG. 1, decreases in the downward direction. When the drive shaft 24, during operation of the crusher 10, rotates the eccentric 20, the crushing head 22 will execute a gyrating movement. A material to be crushed is introduced in the crushing gap 34 and is crushed between the first crushing shell 30 and the second crushing shell 32 as a result of the gyrating movement of the crushing head 22, during which movement the two crushing shells 30, 32 alternately approach and move away from one another. Furthermore, the crushing head 22, and the first crushing shell 30 mounted thereon, will be in rolling engagement with said second crushing shell 32 by way of the material to be crushed. This rolling engagement causes the crushing head 22 to rotate slowly relative to the frame 12 in a direction of rotation that is substantially opposite to the direction of rotation of the eccentric 20.

If no material to be crushed is present in the crushing gap 34, the crushing head 22 will not be in rolling engagement with said second crushing shell 32. Instead, the friction in the bearing mechanism between the eccentric 20 and the crushing head 22 will strive to cause the crushing head 22 to rotate in the same direction and at substantially the same speed as the eccentric 20. Since the speed of rotation of the eccentric 20 is much higher than the typical speed of rotation, during rolling engagement, of the crushing head 22, the crushing head 22 too, unless it is braked in some way, will reach a high speed of rotation when there is no material in the crushing gap 34. Such a significant increase of the rotational speed of the crushing head 22 in a direction of rotation opposite to the direction of rotation during the rolling engagement described above will be referred to below as "spinning". Accordingly, when material is present in the crushing gap 34 and the crushing head 22 is in rolling engagement with the second crushing shell 32, the crushing head 22 rotates slowly in a first direction of rotation, which is opposite to the direction of rotation of the eccentric 20. On the other hand, when no material, or only very little material, is present in the crushing gap 34, there is a risk that the crushing head 22, unless it is braked, quickly starts to rotate in a second direction of rotation, which is the same as the direction of rotation of the eccentric 20, which means that the crushing head 22 is spinning. Spinning is undesirable and may result in increased wear of the crushing shells 30, 32. Spinning may also result in the feed material to be crushed being ejected from the feed opening of the crusher 10. Moreover, if the crusher 10 frequently alternates between spinning and normal operation the wear of the crusher bearings may increase.

The crusher 10 is provided with a device that reduces the tendency of the crushing head 22 to spin. Such a device will be described below.

The crushing head 22 is supported on a support piston 36, which is hydraulically vertically adjustable in a space 44 formed in the central shaft 18. The support piston 36 is rotationally locked to the central shaft 18. The purpose of the vertical adjustability is, inter alia, to enable any wear of the crushing shells 30, 32 to be compensated for, but also to allow the width of the gap 34 to be varied, in order to produce crushed material of different sizes. The crushing head 22 is carried on a set of thrust bearings 38, which are disposed between the crushing head 22 and the support piston 36 and which are supported by the support piston 36. The thrust bearings 38 enable tilting of the crushing head 22 during the gyrating movement thereof.

The support piston 36 is connected to the crushing head 22 by way of a wet disc clutch 40, an anti-reverse 42, and a universal joint shaft 46. The wet disc clutch 40, the anti-reverse 42 and a portion of the universal joint shaft 46 are located in a substantially cylindrical space 45 formed inside the support piston 36. By placing the wet disc clutch 40 and the anti-reverse 42 in the space 45, the total height of the crusher 10 is reduced. A further advantage is that in the event that the wet disc clutch 40 or the anti-reverse 42 should break down parts thereof will most likely remain in the space 45. As a result, consequential damage to, for example, the thrust bearings 38 can be avoided.

The anti-reverse 42 allows the crushing head 22 to rotate in the direction of rolling engagement associated with normal operation, while preventing the crushing head 22 from rotating in the same direction as the eccentric 20.

The purpose of the wet disc clutch 40 is to protect the anti-reverse 42 and other components from being damaged in the event that jamming of the bearing mechanism between the crushing head 22 and the eccentric 20 should occur, whereby the eccentric 20 would force the crushing head 22 to rotate with the eccentric 20. This may occur, for example, because the viscosity of the lubricant in said bearing mechanism between the crushing head 22 and the eccentric 20 is high before the crusher 10 has reached its working temperature, for example when cold starting the crusher 10 in a cold winter climate.

The universal joint shaft 46 is provided with universal joints 53, which enable the universal joint shaft 46, at the point of attachment to the crushing head 22, to move with the gyrating movement of the crushing head 22. The universal joint shaft 46 is further provided with projecting portions, in the form of splines, which extend along the universal joint shaft 46 and which allow the length of the universal joint shaft 46 to be adjusted to compensate for the heat expansion and wear of for instance, the thrust bearings 38.

Figure 2A:
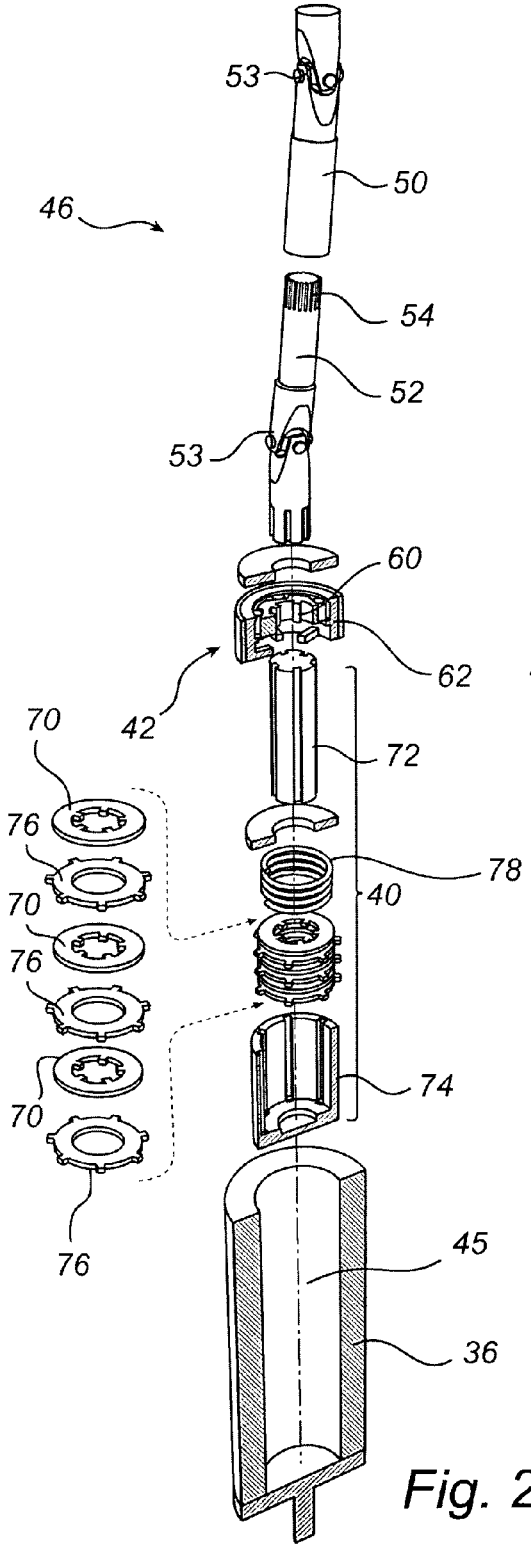
FIGS. 2*a*-2*b* are schematic perspective views, partly in section, of components incorporated in the central shaft shown in FIG. 1.
Figure 2B:
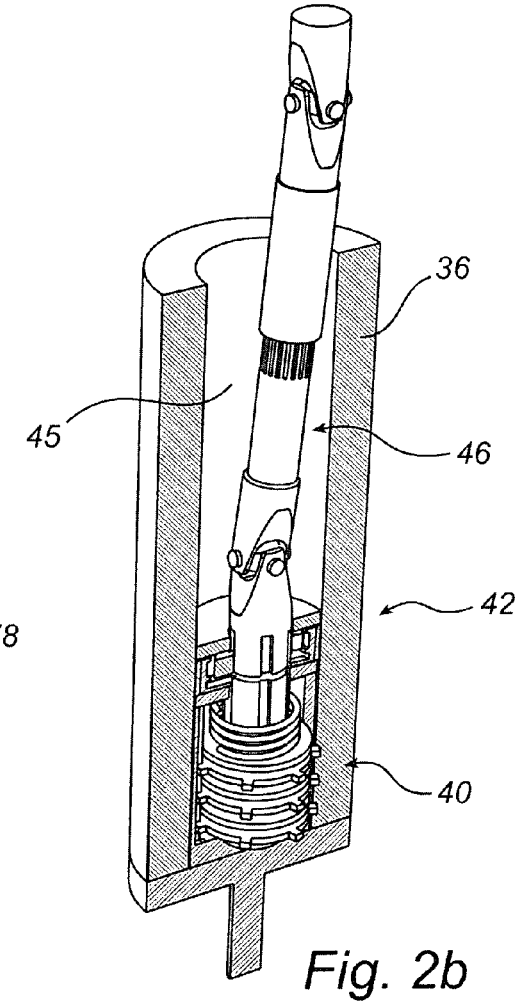

FIGS. 2*a* and 2*b* show in more detail the support piston 36 and the connection of the same to the crushing head 22, FIG. 2*a* being an exploded version of the view in FIG. 2*b*. The universal joint shaft 46, which is arranged to transfer a rotary movement from the crushing head 22, is divided into an upper shaft section 50 and a lower shaft section 52. The two shaft sections 50, 52 are axially displaceable relative to each other by means of projecting portions, in the form of splines 54, which are provided on the shaft sections 50, 52 and which extend along the length of the universal joint shaft 46.

The universal joint shaft 46 transfers the rotary movement to a connecting member 60 on the input side of the anti-reverse 42. The connecting member 60 on the input side of the anti-reverse 42 can be rotated unobstructed in the direction of rolling engagement of the crushing head 22 associated with normal operation. When rotating the connecting member 60 on the input side in the reverse direction of the anti-reverse, i.e. in the direction of rotation of the eccentric, the connecting member 60 on the input side of the anti-reverse engages with a connecting member 62 on the output side. The connecting member 62 on the output side then transfers the rotation to the wet disk clutch 40, which is adapted to brake the rotation. The wet disc clutch 40 comprises a first set of discs 70, which are rotationally locked to an input shaft 72. The discs 70 are arranged in a clutch housing 74 and are disposed alternatingly with a second set of discs 76, which are rotationally locked to the clutch housing 74. The clutch housing 74 is, in its turn, rotationally locked to the support piston 36 and the crusher frame 12. A coil spring 78 is arranged to compress the discs 70, 76, whereby the friction between the discs generates the braking effect that brakes a rotation of the crushing head 22 in the direction of rotation of the eccentric 20. The clutch is a wet-type clutch, i.e. the clutch housing 74 contains oil. An advantage associated with a wet clutch is that it is not affected by splashes of grease and oil from other components incorporated in the crusher. In one embodiment, the anti-reverse 42 too is immersed in oil and the universal joint shaft 46 is completely or partially immersed in oil.

The braking action of the wet disc clutch 40 is adjusted such that the clutch starts to slip if the torque that is transmitted from the connecting member 62 on the output side of the anti-reverse 42 to the wet disc clutch 40, by way of the shaft 72, exceeds a predetermined value. This predetermined value is selected in such a manner that the wet disc clutch 40 starts to slip before any damage is caused to the anti-reverse 42 or the universal joint shaft 46.

It will be appreciated that various modifications of the embodiments described above are conceivable within the scope of the invention, as defined by the appended claims.

For example, the anti-reverse may be of many different types and may have different properties. Examples of anti-reverse mechanisms are free wheeling clutches, one-way clutches, ratchet wheels, etc. According to one embodiment, the anti-reverse allows a slow rotation also in the direction of rotation of the eccentric, but inhibits rotation when the speed of rotation in this direction reaches a limit speed of, for example, 10 revolutions per minute.

Moreover, the torque limiter 40 may be of many different types; it may for example be a mechanical or hydraulic slip clutch, or a sacrificial component, which is dimensioned to break at an overload condition to spare the anti-reverse.

In the detailed description, the torque limiter 40 and the anti-reverse 42 have been shown as arranged inside a vertically adjustable support piston 36. It is possible, of course, to arrange the torque limiter 40 and the anti-reverse 42 directly in the space 44 formed in the central shaft 18, for instance in the case where the vertical adjustability of the first or second crushing shell 30, 32 is accomplished in a different manner, or where the crusher gap 34 has a fixed width.

The central shaft 18 described above is shown as arranged on a gyratory crusher of the type that is without a top bearing. Naturally, a central shaft of this kind may well be mounted on a gyratory crusher with a top bearing as well as on other types of gyratory crushers.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A central shaft for a gyratory crusher, comprising:

a crushing head on which a first crushing shell is mounted;

a frame on which a second crushing shell is mounted, the second crushing shell and first crushing shell defining a crushing gap; and a driving device arranged to rotate an eccentric about said central shaft and thereby to cause the crushing head to execute a gyratory movement for crushing of material that is introduced in the crushing gap, wherein the central shaft has a cavity in which are accommodated an anti-reverse and a torque limiter, the anti-reverse and the torque limiter for connection to said crushing head for restricting spinning.

2. The central shaft according to claim 1, wherein the cavity has an opening in the upper end surface of the central shaft.

3. The central shaft according to claim 1, wherein the central shaft comprises a support piston, which is arranged in the cavity and which is vertically displaceable relative to the central shaft.

4. The central shaft according to claim 3, wherein the support piston supports and at least partly surrounds the torque limiter and the anti-reverse.

5. The central shaft according to claim 3, wherein the support piston supports a thrust bearing on which the crushing head is carried, the torque limiter and the anti-reverse being disposed under said thrust bearing.

6. The central shaft according claim 1, wherein the torque limiter is a slip clutch.

7. The central shaft according to claim 6, wherein the slip clutch is a wet disc clutch.

8. The central shaft according to claim 1, wherein the anti-reverse is located above the torque limiter.

9. A gyratory crusher, comprising:

a crushing head on which a first crushing shell is mounted;

a frame on which a second crushing shell is mounted, the second crushing shell and first crushing shell defining a crushing gap;

a central shaft having a cavity in which are accommodated an anti-reverse and a torque limiter, the anti-reverse and the torque limiter for connection to said crushing head for restricting spinning;

an eccentric being rotatably arranged about said central shaft; and a driving device, which is arranged to rotate the eccentric and thereby to cause the crushing head to execute a gyratory movement for crushing of material that is introduced in the crushing gap, the crushing head being connected to the central shaft by way of said anti-reverse and said torque limiter.

10. The crusher according to claim 9, wherein the crushing head is connected to the central shaft by way of a universal joint shaft, which is provided with at least one universal joint.

11. The crusher according to claim 10, wherein the universal joint shaft is divided into an upper shaft section and a lower shaft section, which shaft sections are rotationally locked together and axially displaceable relative to each other by means of at least one projecting portion, which extends along the universal joint shaft.

12. The crusher according to claim 11, wherein the at least one projecting portion includes a spline.

* * * * *